US007247185B2

(12) United States Patent
Jobson et al.

(10) Patent No.: US 7,247,185 B2
(45) Date of Patent: Jul. 24, 2007

(54) DEVICE FOR TREATMENT OF A GAS FLOW

(75) Inventors: Edward Jobson, Romelanda (SE); Anna Holmgren Hägg, Torslanda (SE)

(73) Assignees: Volvo Technology Corporation, Gothenburg (SE); Ford Global Technologies LLC, Dearborn, MI (US)

( * ) Notice: Subject to any disclaimer, the term of this patent is extended or adjusted under 35 U.S.C. 154(b) by 0 days.

(21) Appl. No.: 10/710,969

(22) Filed: Aug. 15, 2004

(65) Prior Publication Data

US 2005/0138907 A1 Jun. 30, 2005

Related U.S. Application Data

(63) Continuation of application No. PCT/SE03/00223, filed on Feb. 11, 2003, now abandoned.

(51) Int. Cl.
*B01D 46/00* (2006.01)
*F01N 3/022* (2006.01)
*F01N 3/10* (2006.01)

(52) U.S. Cl. ..... 55/523; 55/282.3; 55/385.3; 55/410; 55/418; 55/482; 55/524; 55/DIG. 10; 55/DIG. 30; 60/274; 60/282; 60/297; 60/299; 60/300; 60/303; 60/311; 96/108; 96/154; 96/384; 96/386; 423/212; 423/213.2; 422/170; 422/180; 422/182

(58) Field of Classification Search ..... 55/282.2, 55/282.3, 385.3, 410, 418, 523, 524, DIG. 10, 55/DIG. 30, 482; 96/108, 154, 384, 385, 96/386; 60/274, 282, 297, 299, 300, 303, 60/311; 423/210, 212, 213.2, 213.5, 213.7; 428/116, 117, 118; 502/439; 422/169, 170, 422/171, 180, 182, 183
See application file for complete search history.

(56) References Cited

U.S. PATENT DOCUMENTS 3,785,781 A * 1/1974 Hervert et al. ..... 422/171
3,885,977 A 5/1975 Lachman et al.
4,659,348 A * 4/1987 Mayer ..... 55/DIG. 30

(Continued)

FOREIGN PATENT DOCUMENTS

DE 19858974 A1 6/2000

(Continued)

*Primary Examiner*—Jason M. Greene
(74) *Attorney, Agent, or Firm*—Novak Druce + Quigg, LLP

(57) ABSTRACT

Device for treatment of a gas flow having at least one body (3) that is adapted to cause a conversion in the composition of the gas. The device is characterized in that the body (3) has a modular construction comprising a plurality of sections (26, 26', 27, 27', 36) with different internal structures that allow gas to flow through the section, and that the sections (26, 26', 27, 27', 36) are arranged so that at least a portion of the gas flows through at least two sections with different internal structures during operation of the device.

33 Claims, 7 Drawing Sheets

U.S. PATENT DOCUMENTS 5,328,774 A * 7/1994 Maus et al. ..... 422/180
5,403,559 A * 4/1995 Swars ..... 422/180
5,660,800 A * 8/1997 Mieville et al. ..... 60/297
5,685,143 A * 11/1997 Aitta et al. ..... 60/274
5,746,989 A * 5/1998 Murachi et al. ..... 60/301
5,863,508 A * 1/1999 Lachman et al. ..... 422/171
5,884,474 A * 3/1999 Topsoe ..... 60/274
6,190,624 B1 2/2001 Romatier
6,220,021 B1 * 4/2001 Frederiksen et al. ..... 60/299
6,293,096 B1 * 9/2001 Khair et al. ..... 60/297
6,314,722 B1 * 11/2001 Matros et al. ..... 60/297
6,475,453 B1 * 11/2002 Mathes et al. ..... 502/439
6,889,498 B1 * 5/2005 Chandler et al. ..... 60/311
6,916,450 B2 * 7/2005 Akama et al. ..... 422/180

FOREIGN PATENT DOCUMENTS

DE 10003090 A1 7/2001
WO WO 9214912 A1 9/1992
WO WO 9518292 A1 7/1995

* cited by examiner

B–B

A–A

D-D

C-C

B-B

A-A

DEVICE FOR TREATMENT OF A GAS FLOW

CROSS-REFERENCE TO RELATED APPLICATIONS

The present application is a continuation patent application of International Application No. PCT/SE03/00223 filed 11 Feb. 2003 now abandoned which was published in English pursuant to Article 21(2) of the Patent Cooperation Treaty, and which claims priority to Swedish Application No. 0200453-9 filed 15 Feb. 2002. Said applications are expressly incorporated herein by reference in their entireties.

TECHNICAL FIELD

The invention generally relates to a device for treatment of a gas flow. In particular, the invention relates to a device for catalytic purification of exhaust gases emanating from internal combustion engines.

BACKGROUND ART

Exhaust gases emanating from such devices as internal combustion engines and industrial processes generally contain potentially hazardous compounds such as hydrocarbons (HC), carbon monoxide (CO), oxides of nitrogen (NOX) and particulates. Such compounds need to be converted to harmless, or at least less hazardous, compounds in order to reduce the amount of hazardous compounds released to the environment. Commonly the exhaust gases undergo some form of catalytic treatment and/or filtering process.

In most conversion-type treatments of interest in the present context, temperature is an important aspect.

Many important conversion reactions require a rather high temperature. The use of catalysts, for example metals or metal oxides from the platinum group, makes it possible to convert the hazardous compounds with a satisfactory reaction rate at a much lower temperature than if such catalysts were not used. However, a high reaction rate can only be achieved if the temperature is sufficient; that is, above the so called light-off temperature at which the catalyzed reaction rate becomes significant. The light-off temperature is usually in the range 200-400° C. If the light-off temperature has not yet been reached, or if the temperature falls below light-off so that conversion stops, almost no hazardous compounds will be converted. These are well-known problems associated with such things as the cold starting of an internal combustion engine (with a similarly cold catalyzer) and with "cold" exhaust gases, such as those emanating from a diesel engine.

The temperature is further important in regeneration of purification devices, for instance, the removal of trapped particles by combustion or the removal of impurities such as sulphur oxides (SOx) from a catalytic device. Such processes can be cyclic and involve a temperature increase to around 600° C. for a certain time period. As the purification devices normally degrade if they are exposed to overly high temperatures, there is an upper temperature limit that should not be exceeded. Thus, it is not only the temperature that is an important feature, but also the control of the temperature during both conversion (to achieve a good conversion) and during regeneration (to achieve a suitable cleaning of the converter).

A conventional physical structure of a catalytic converter, as for instance disclosed in U.S. Pat. No. 3,885,977, is a ceramic honeycomb monolith with parallel, open channels.

The catalytic material is deposited onto the walls of the honeycomb channels. As the gas flows from one end to the other, the catalytic conversion takes place. This type of structure generally works well provided that the temperature of the device is above the light-off temperature. However, at cold-start situations it is difficult to avoid that hazardous compounds flow through the channels without conversion.

In order to reduce the amounts of hazardous compounds that are released during cold start it is a well known technique to use adsorption traps, i.e. to deposit a material, besides the catalysts, that adsorbs and retains cold hydrocarbons and/or nitrogene oxides until the catalyst reaches the light-off temperature. As an example, this is disclosed in W095/18292. A problem with this technique when applied to the conventional physical structure described above is that the desorption temperature for most compounds generally is lower than the temperature required for conversion. A great deal of the hazardous compounds will thus still flow through the channels without conversion.

Another approach to solve the problem with cold converters is to introduce electric heating, as disclosed in, for instance W092/14912. It is, however, difficult to make the heating fast enough and the costs for components and energy are high. This kind of electric heating may also be a safety risk (electricity, fire).

From the above, it is apparent that there is a need for improved gas treatment devices.

DISCLOSURE

An object of the present invention is to provide a device for treatment of a gas flow that makes it possible to achieve a higher efficiency in the conversion of the gas, compared to known treatment methods and devices.

A fundamental idea of this invention is its modular construction; that is, a concept of joining a plurality of different sections together into one unit, and by this arrangement, gaining advantageous effects both in the manufacturing process by an efficient production of the individual sections and other parts constituting the body, as well as in the performance of the assembled construction.

The invention concerns a device for treatment of a gas flow, comprising (including, but not necessarily limited to) at least one body that is adapted to cause a conversion in the composition of the gas. The invention is characterized at least in part by the body having a modular construction comprising a plurality of sections with different internal structures that allow gas to flow through the section, and that the sections are arranged so that at least a portion of the gas flows through at least two sections with different internal structures during operation of the device. In other words, the body is arranged so that the gas flows through different types of sections on its way through the body.

In contrast to conventional constructions that consist of only one type of internal structure, the modular construction according to the invention makes it possible to combine advantageous properties of several different types of structures and to construct the body in many different ways. Further, the invention makes it possible to compose a body in such a way that certain technical main functions are assigned to certain sections that have been designed for the purpose; for example, an individual section is designed in such a way that its technical properties are particularly well adapted for a certain function. For instance, a certain type of section may be excellent for conversion purposes, but may suffer from a poor mechanical stability or a high flow resistance, or it may require a certain distribution of the gas flow to work properly. By combining such a section type with one or several other types of sections into one body, it is possible to overcome the drawbacks associated with the individual section types. Further, one type of section structure may be more favorable for conversion close to the inlet of the body, whereas another type of section structure may be more favorable for conversion close to the outlet of the body where the composition and in some cases also the temperature of the gas is different. A body constructed according to the invention can thus be used to increase the conversion efficiency in a gas treatment device.

The modular construction according to the invention is also advantageous in the waste management of a used gas treatment device as the sections can be taken care of individually after separation. For instance, one section may contain chemical elements such as catalyst material that are to be recovered, whereas another section may be dumped or re-used in another construction.

In a first advantageous embodiment of the invention, at least one of the sections exhibits a substantially unchanged cross section in at least one certain direction, preferably a plurality of the sections exhibit a substantially unchanged cross section in at least one certain direction.

An advantageous effect of this feature is that the section (s) may be produced by extruding means which is a cost-effective production method that is well suited for both metal and ceramic material.

In a second advantageous embodiment of the invention, the sections are substantially made out of a ceramic material, preferably the sections are joined together by sintering, preferably the body is substantially made out of a ceramic material. This gives a favorable construction since a properly chosen ceramic material, compared to metal, has a lower cost of material, a lower cost of production, a lower thermal expansion, a better wash-coat adhesion and has a lower thermal mass per wall volume. A construction made out of a ceramic material is also less prone to degrade in the rough environment of an exhaust gas flow.

In a third advantageous embodiment of the invention, the body comprises at least one first section that is provided with a plurality of gas flow passages that extend essentially parallel to each other. Such a structure makes it possible to contact the gas with a large body surface which is advantageous in most types of gas treatment.

In a fourth advantageous embodiment of the invention, the body comprises at least one second section that also is provided with a plurality of gas flow passages that extend essentially parallel to each other, and the number of gas flow passages per cross section area unit differs between the first section and the second section. Thereby, it is possible to utilize the advantages of sections with a large number of passages per area unit; for example, higher heat and mass transfer rates due to a shorter distance between the gas and the body surface (i.e., the wall that separates the passages), with the advantages of sections with a relatively small number of passages per area unit (i.e., a lower flow resistance and, usually, a higher mechanical stability). Preferably, the sections are. arranged in such a way that at least a portion of the walls that define the gas flow passages in the first section form extensions of at least a portion of the walls that define the gas flow passages in the second section. Such an arrangement increases the mechanical stability of the construction and decreases the abrasion of the walls during operation, particularly in the case where the walls are sintered together.

In a fifth advantageous embodiment of the invention, the body is arranged to permit heat exchange between the gas flows in adjacent gas flow passages. This feature makes it possible to utilize the heat in the gas in a more efficient way which is an advantage under most operation conditions of a gas treatment device. A good heat economy is especially important if the incoming gas flow is relatively cold so that the temperature might fall below the catalyst light-off temperature described previously. Preferably, the device is arranged so that the main direction of the gas flow in one gas flow passage is essentially the opposite of the main direction of the gas flow in an adjacent gas flow passage during operation of the device.

Thereby it is possible to achieve a counter-current heat exchange process for highest efficiency.

In a sixth advantageous embodiment of the invention, the gas flow passages form inlet passages that are intended for an incoming gas flow and outlet passages that are intended for an outgoing gas flow. A reversing zone is arranged in connection with the first section so that gas entering the reversing zone from the inlet passages is permitted to change direction and flow back through the outlet passages. Such an arrangement is simple and makes it possible to achieve a counter-current heat exchange process. Further, this arrangement makes it possible to, during cold start situations, adsorb compounds in or close to the reversing zone until the rest of the body has reached the catalyst light-off temperature.

In a seventh advantageous embodiment of the invention, the body comprises at least one second section that is provided with at least one first opening for the entrance of an incoming gas flow, and the second section is arranged in connection-to at least one first section, and the second section is adapted to distribute the incoming gas flow to the the inlet passages.

Preferably, the second section is provided with at least one second opening for the exit of an outgoing gas flow, and the second section is adapted to lead the outgoing gas flow out from the outlet passages. Such an arrangement gives an appropriate distribution of the gas flow and makes it possible to give the device a compact design. Additionally, it makes it possible to perform heat exchange also in the second section.

In an eighth advantageous embodiment of the invention, the second section comprises a wall structure forming at least one first channel to which the incoming gas flow is fed, and a plurality of second channels that extend from the first channel and which second channels are open to the inlet passages. This enables a simple construction and a good distribution of the incoming gas flow. Preferably, the first channel is closed to the gas flow passages. Thereby the incoming gas is forced to flow via the second channels which leads to a uniform distribution of the gas flow within the individual inlet passages. In a further improvement, the wall structure forms a plurality of third channels that are open to the outlet passages, preferably the third channels are formed between the second channels (30) using common walls. This is an advantageous way of leading the gas out as heat exchange can take place also in the second section, and as no additional walls are needed.

In a ninth advantageous embodiment of the invention, the second section comprises a zigzag shaped wall structure forming a first and a second set of channels, one set on each side of the zigzag shaped structure, wherein the first set of channels are open to the inlet passages and the second set of channels are open to the outlet passages, and wherein the incoming gas flow is fed to the first set of channels. Also this design enables a simple construction and a good distribution of the incoming gas flow, and makes it possible to perform heat exchange also in the second section.

In a tenth advantageous embodiment of the invention, the first section comprises an internal cavity that extends substantially parallel to the gas flow passages, and the gas flow passages are distributed around the internal cavity. Preferably, the second section comprises an internal cavity, and at least one first or second opening is directed towards the cavity so that gas flows via the cavity during operation of the device. Preferably, the body has a substantially cylindrical shape, preferably the body has a general shape of a circular cylinder, and that the body comprises an internal cavity that extends in the longitudinal direction of the body, and that the device is arranged in such a way that either incoming gas enters or outgoing gas exits the body via the internal cavity during operation of the device. Such a body can easily be composed using sections of the type previously described in this paragraph. An advantageous effect of this design is that the device require less space. A further advantage, especially in a vehicle exhaust gas purification application, is that the device can be made with a long and narrow physical shape that can be arranged with its longitudinal axis in line with the exhaust pipe. By distributing the gas flow passages around the internal cavity and/or along the longitudinal axis of the body, this design enables a low pressure drop and advantageous packing properties.

In an eleventh advantageous embodiment of the invention, the body comprises at least one third section provided with walls that are permeable to the gas flow, the third section being primarily adapted to remove particulates from the gas. In this manner it is possible to use the device for filtering purposes, which is important in for instance the purification of exhaust gases emanating from a diesel engine. Preferably, the third section is arranged between the first section and the reversing chamber, and the permeable walls essentially defines an extension of the gas flow passages in the first section, and the outlet passages are closed to the reversing chamber so that the gas is forced to flow through the permeable walls during operation of the device. Such a design has several advantageous characteristics, including: the actual construction is relatively simple; ash and soot can accumulate in the reversing chamber instead of occupying useful filter volume; in combination with the heat exchange properties of the invention, the regeneration of the filter can be carried out very efficiently as the heat evolved in this process can be used for preheating purposes. Further, the third section may be produced by extruding means in similarity to the first and second sections.

DESCRIPTION OF DRAWINGS

The invention will now be described in more detail with reference to the following drawings where.

MODE FOR INVENTION

Figure 1:
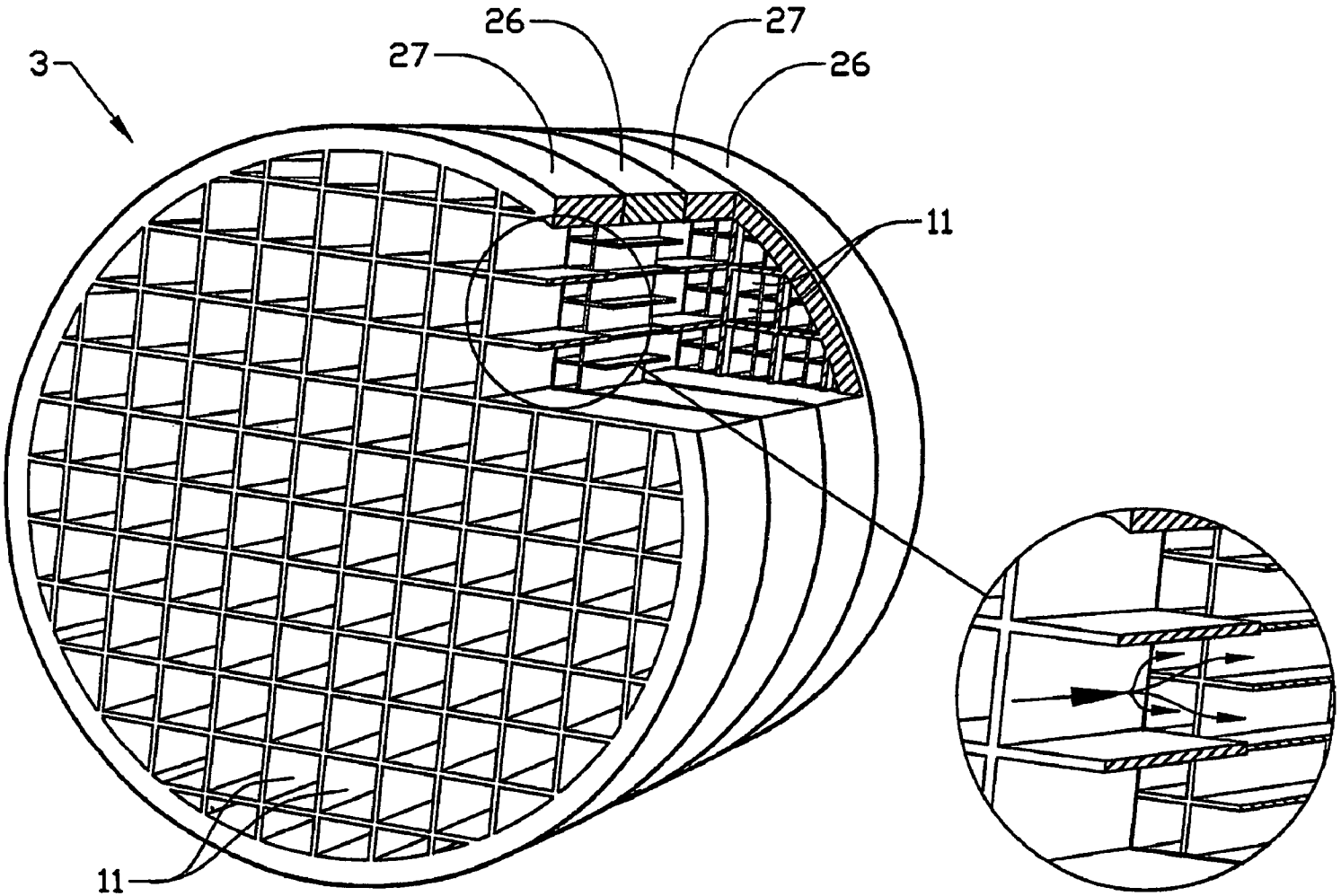
FIG. 1 is a schematic perspective view showing a first advantageous embodiment of the invention.

FIG. 1 shows, in a schematic view, a first advantageous embodiment of the invention. Two first sections 27 and two second sections 26 have been joined together as to form a body 3.

Both the first sections 27 and the second sections 26 are provided with a plurality of gas flow passages 11 that extend essentially parallel to each other. The number of gas flow passages 11 per cross section area unit is four times higher in the second section 26 compared with the first section 27. A portion of the walls defining the gas flow passages 11 in the second section 26 thus form an extension of all the walls defining the gas flow passages 11 in the first section. A part of the body 3 has been removed in the Figure to show the internal structure more clearly. During operation of the device the gas will flow through the body 3 as indicated by the arrows in the magnified part of the Figure; gas entering the body 3 will thus experience low and high numbers of gas flow passages 11 per cross section area unit in an alternating manner. Preferably, the surfaces of the body 3 that comes into contact with the gas are coated with a catalyst material. Depending on the application, also an adsorption/desorption agent may be applied to the surfaces.

The number of flow passages (or channels) per cross section area unit is normally referred to as the channel density, which usually is expressed in cpsi (channels per square inch). In applications concerning vehicle exhaust gas purification, a typical value of the channel density is 400 cpsi, but channel densities of 600 and 900 cpsi have also been used in more recent applications. The sections in FIG. 1, which only shows a schematic view of the first embodiment of the invention, could thus for instance correspond to 200 cpsi (the first section 27) and 800 cpsi (the second section 26).

The general advantage of using a higher channel density is that the distance between the gas and the body surfaces (i.e. the walls that separates the channels/passages 11) becomes shorter which leads to higher heat and mass transfer rates. A high mass transfer rate is especially important in high flow rate situations where it is important that an efficient conversion can be achieved in a small body volume. A high heat transfer rate is especially important to rapidly reach the light-off temperature, particularly in cases where the increased channel density leads to a decrease in total thermal mass of the body 3. An increased channel density makes it possible to make the channel walls thinner, but this does not necessarily lead to a decreasing thermal mass of the body 3 as the number of walls increase at the same time.

A general disadvantage of using a higher channel density is that the flow resistance increases, which only partly can be compensated for by decreasing the total volume of the body. The high flow resistance makes it necessary to give the body a more wide and short shape, i.e. if the channel density increases, the diameter of the body (perpendicular to the direction of the gas flow) needs to be increased and the length of the body (parallel to the direction of the gas flow) needs to be shortened. Such a body shape suffers from a low mechanical stability, especially if the walls are made thinner.

By composing a body 3 as schematically shown in FIG. 1 it is possible combine the advantageous properties of low and high cell densities. The second sections 26 are provided with a large number of gas flow passages 11 per cross section area unit and they therefore contribute with a high mass and heat transfer for efficient conversion and rapid light-off. The first sections 27 are provided with a relatively low number of gas flow passages 11 per cross section area unit and contribute to the conversion of gas, but contribute also with mechanical stability. By combining the first 27 and second 26 sections in an alternating manner it is possible to utilize the advantageous of a high cell density and at the same time keep the flow resistance at a reasonably low level and give the body 3 a relatively long and narrow shape for high mechanical stability.

As shown in FIG. 1, the walls that define the gas flow passages 11 in the second section 26 are made thinner than the walls of the first section 27, in order to further shorten the time to reach the light-off temperature. By joining the sections together, the walls in the second sections 26 can be made very thin as the first sections 27 stabilize the construction. This is especially true if the sections, including the walls, are made in a ceramic material and are sintered together. The relatively thick walls in the first section 27 are useful for heat storage.

However, the advantageous effects of the invention can be utilized even if the walls in the different sections are of the same thickness.

As seen from FIG. 1, the sections exhibit a substantially unchanged cross section in the direction corresponding to the main direction of the gas flow (downwards through the paper).

It is thus possible to produce the individual sections by extruding means which is suitable for both metal and ceramic material, and to join them together after the extruding process.

Metallic sections are preferably joined by soldering, whereas ceramic sections are preferably sintered together. The advantages of using a ceramic material are described previously.

Figure 2:
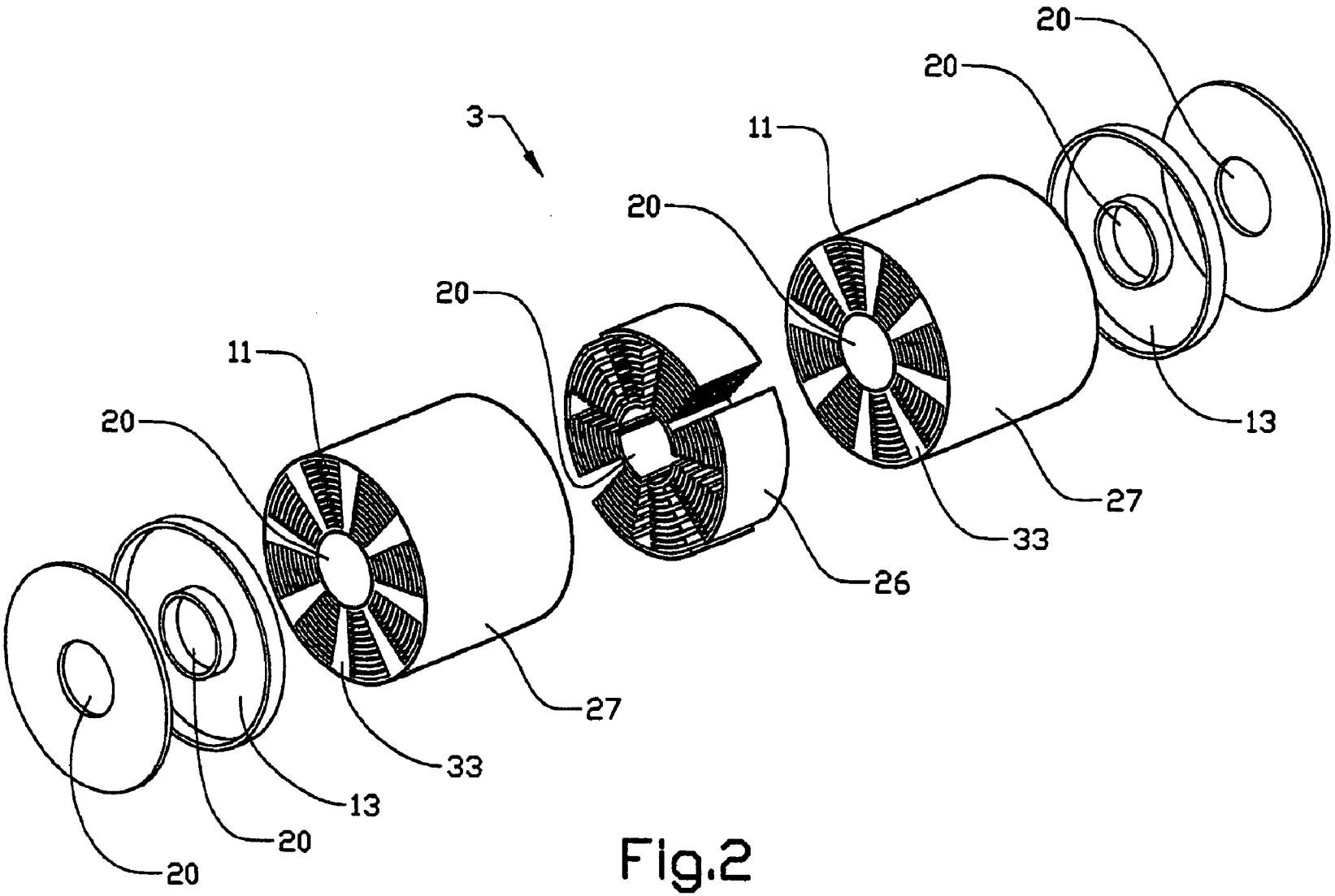
FIG. 2 is an exploded perspective view of a second advantageous embodiment of the invention.

A second advantageous embodiment of the invention is shown in FIGS. 2 through 9. In this embodiment the body is arranged to perform heat exchange between gas flows in adjacent gas flow passages. FIG. 2 shows, in an exploded perspective view, the structure of a body 3 comprising one second section 26, two first sections 27 and two reversing sections that comprise reversing zones in the form of reversing chambers 13. Each first section 27 is provided with a plurality of gas flow passages 11 and, compared with the thin walls defining the gas flow passages 11, relatively thick supporting walls 33 that divides the first section 27 into a number of sectors. The body 3 has the shape of a circular cylinder and comprises an internal cavity 20 that extends in the longitudinal direction of the body. The incoming gas flow is fed into the body 3 via the internal cavity 20 and the outgoing gas flow leaves the body 3 via its periphery. These flow processes are further described below. The internal structures, and thereby the technical properties, differ between the different sections in that i) the first section 27 is primarily adapted to cause a conversion in the composition of the gas and to permit a heat exchange process, ii) in that the second section 26 is primarily adapted to distribute the gas in to and out from the first section 27, iii) and in that the reversing section is primarily adapted to form a counter-current flow system by allowing the gas to change direction and flow back via another flow passage.

Figure 3:
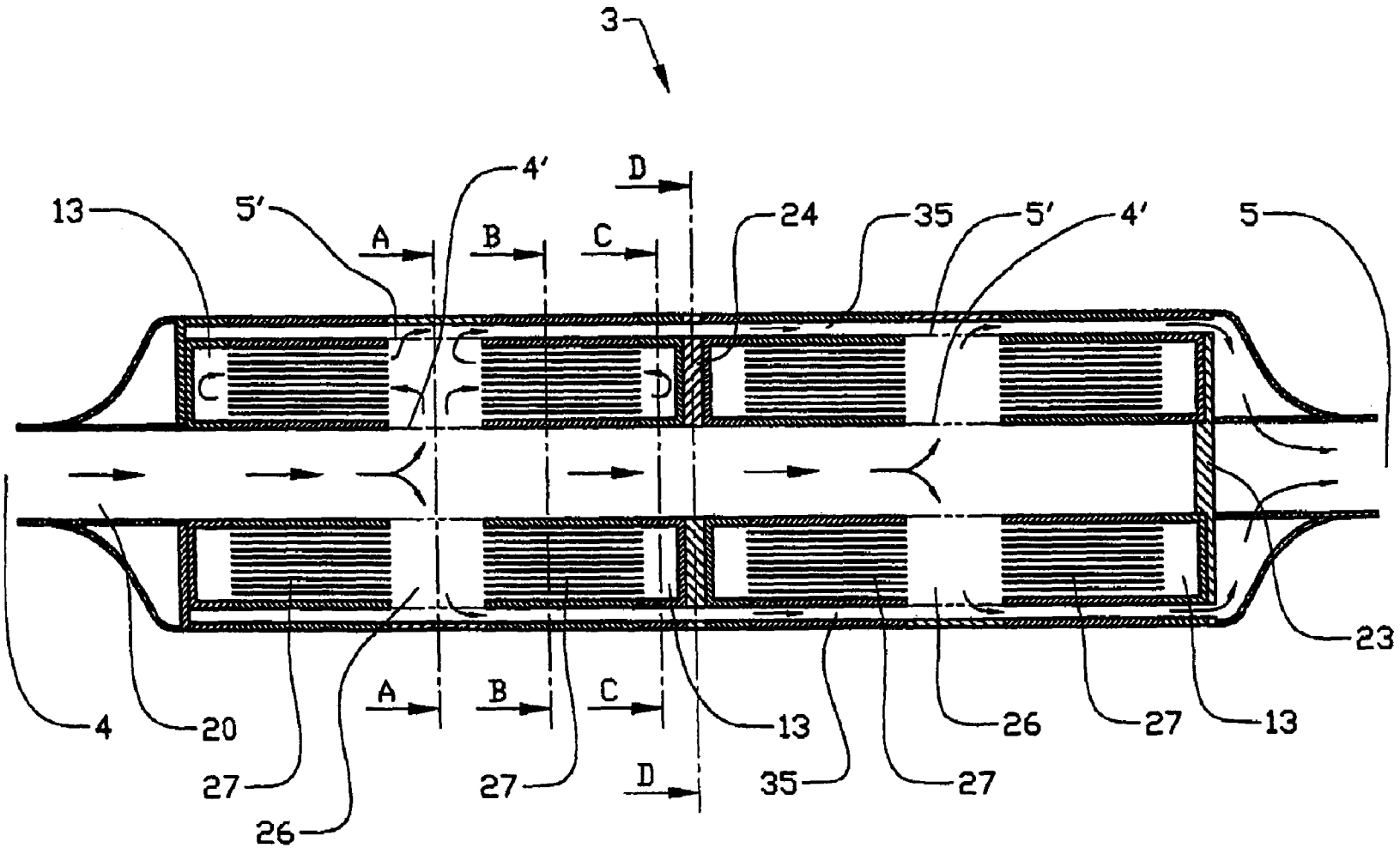
FIG. 3 is a schematic sectional view of a variant of the second advantageous embodiment of the invention shown in FIG. 2.

FIG. 3 shows a schematic sectional view of a variant of the second embodiment wherein the body 3 constitutes two sub-bodies that have been joined together, and wherein each sub-body has a structure according to FIG. 2. The body 3 has also been provided with surrounding equipment for leading the gas to and from the body 3. FIGS. 4, 5, 6 and 7 show sectional views A-A, B-B, C-C and D-D, respectively, according to FIG. 3. The structure of the second section 26 is not shown in FIG. 3, but in FIG. 4.

Figure 5:
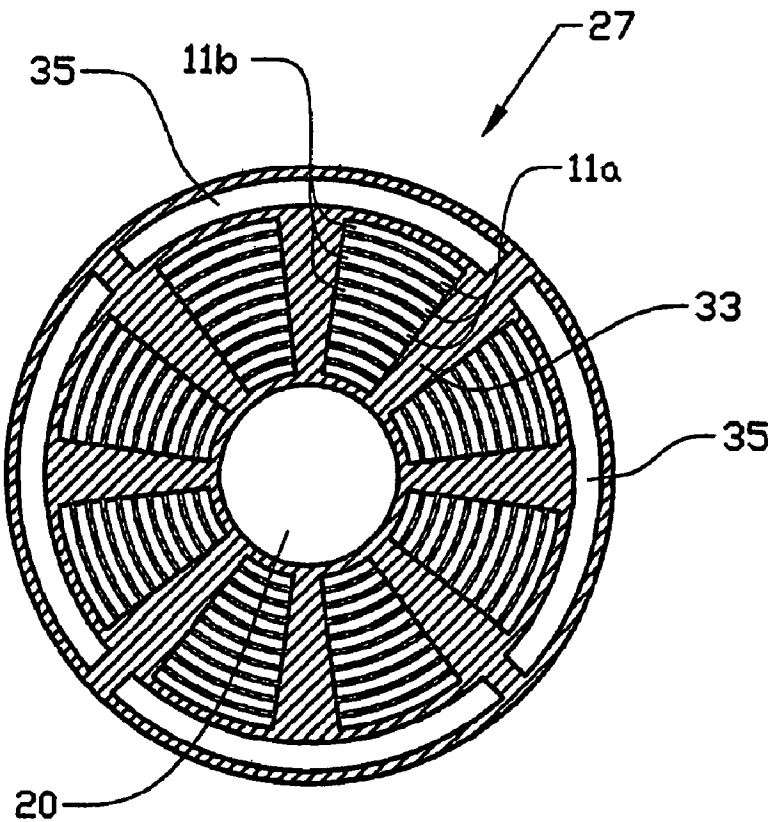
FIG. 5 is a cross-sectional view taken along line B-B in FIG. 3.
Figure 4:
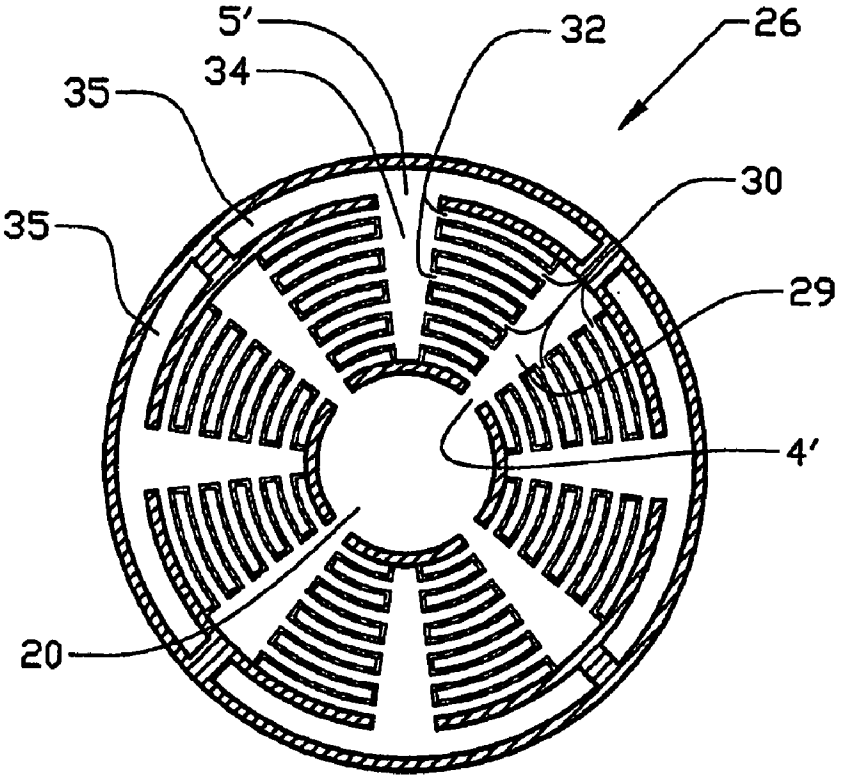
FIG. 4 is a cross-sectional view taken along line A-A in FIG. 3.

The incoming gas flow is fed into the body 3 through the entrance opening 4 into the internal cavity 20. The other end 23 of the cavity 20, opposite to that of the entrance opening 4, is closed which has the effect that the incoming gas flow is forced through the first openings 4' of each second section 26. As can be seen in FIG. 4, the second section 26 constitutes of a wall structure forming (as an example) four first channels 29 that communicate with the internal cavity 20 via the first openings 4' and to which first channels 29 the incoming gas flow is fed. The wall structure further forms a plurality of second channels 30 (in the Figure there are, as an example, five in each direction) that extend from each of the first channels 29. As can be seen in FIG. 5, the first section 27 is provided with a plurality of gas flow passages 11*a*, 11*b*. Every second of these passages forms an inlet passage 11*a* intended for an incoming gas flow, and every second passage forms an outlet passage 11*b*, intended for an outgoing gas flow. The second channels 30 (FIG. 4) are open to the gas flow inlet passages 11*a*, whereas the first channels 29 are closed to all gas flow passages 11*a*, 11*b* by the ends of the supporting walls 33. In order to make it possible to use thinner supporting walls 33 and thereby decrease the amount of construction material in the body, the direct passage from the first channels 29 to the gas flow passages 11*a*, 11*b* can be closed by blocking means, for instance thin plates, or by plugging appropriate parts of the passages. As the incoming gas flow is fed through the first openings 4' into the first channels 29, the gas is forced to be distributed into the second channels 30. From the second channels 30, the gas flow is fed to the inlet passages 11*a*. Further, the gas flows through the inlet passages 11*a* and enters the reversing chamber 13 allowing the gas flow to change direction and flow back to the second section 26 via the outlet passages 11*b*. The wall structure forming the first channels 29 and the second channels 30 in the second section 26 also forms a plurality of third channels 32 (in the Figure there are, as an example, five in each direction) between the second channels 30 using common walls. The third channels 32 are open to the gas flow outlet passages 11*b*.

Two sets of the third channels 32 emerge into a common fourth channel 34. In FIG. 4 it can be seen that the second section 26, as an example; is provided with four fourth channels 34.

The outgoing gas flow enters the third channels 32 from the outlet passages 11*b* and exits the second section 26 via the fourth channels 34 and a second opening 5' into an outlet channel 35 in the periphery of the body 3. At the end of the body 3, opposite to that of the entrance opening 4, the outlet channels 35 are combined to a common exit opening 5 for the exit of the outgoing gas flow from the body 3.

Figure 6:
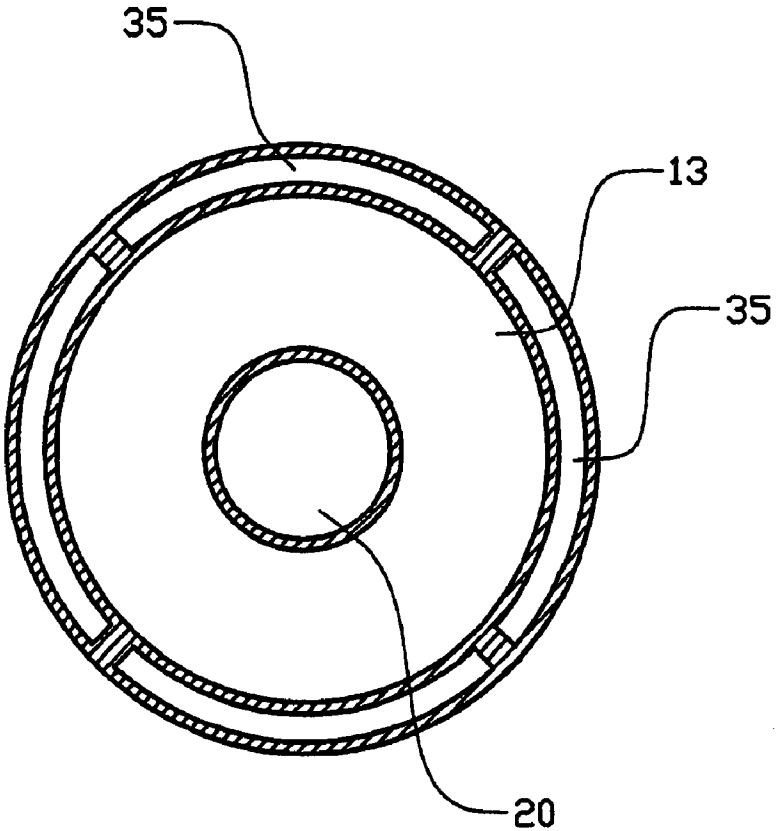
FIG. 6 is a cross-sectional view taken along line C-C in FIG. 3.

FIG. 6 shows a sectional view of the section comprising the reversing chamber 13. As a variant, the reversing chamber 13 could be divided up into a number of sectors. FIG. 6 also shows the internal cavity 20 and the outlet channels 35.

Figure 7:
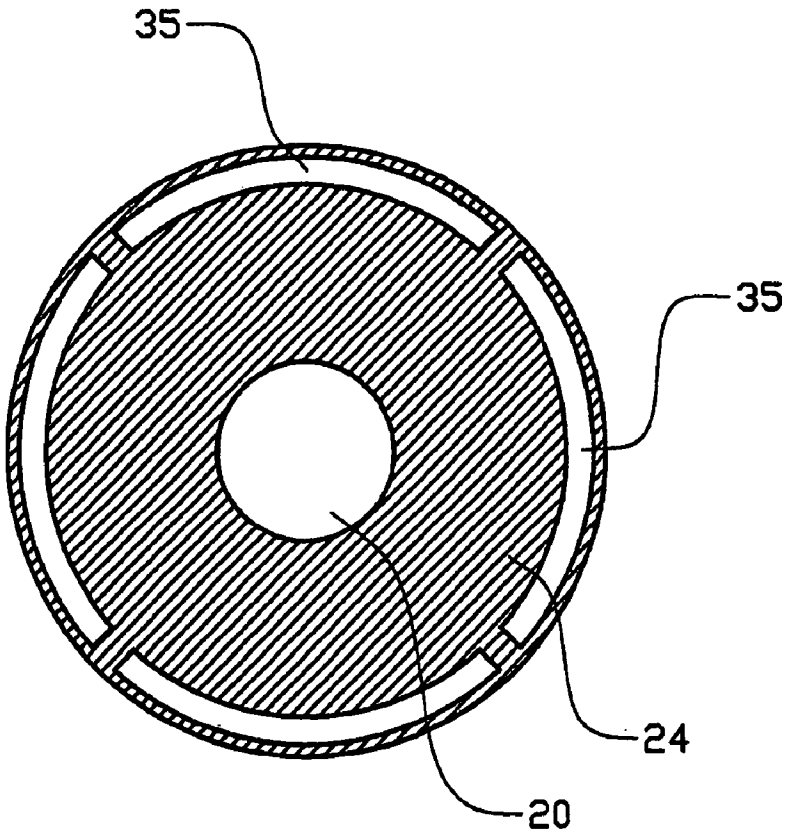
FIG. 7 is a cross-sectional view taken along line D-D in FIG. 3.

FIG. 7 shows a sectional view of a delimiting plate 24 located between the two sub-bodies. Such plates 24 can be used to stabilize the construction. As an alternative to what is shown in FIG. 3, the delimiting plate 24 may form the end part of the reversing chambers 13 of two adjacent sub-bodies.

In order to lead the gas to the body 3, a pipe (for instance an exhaust pipe) is preferably inserted through the entrance opening 4 all the way to the other end 23 of the internal cavity 20. By providing the pipe with openings around its circumference at a location corresponding to the location of the second section(s) 26, the gas is permitted to flow into the second section(s) via the first openings 4'. A pipe provided with openings can also be inserted through the exit opening 5 in order to lead the gas away from the body 3. Such inserted pipes can be used to stabilize the construction.

Figure 9:
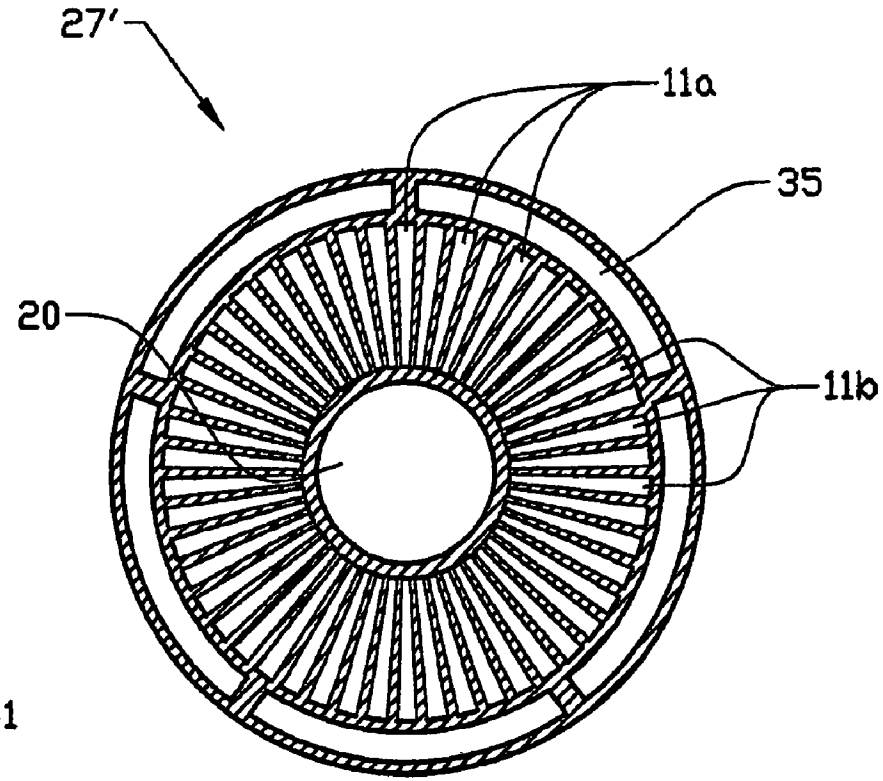
FIG. 9 is a cross-sectional view taken at the position of line B-B in FIG. 3, but demonstrating an alternative variant of the second advantageous embodiment of the invention shown in FIG. 8.
Figure 8:
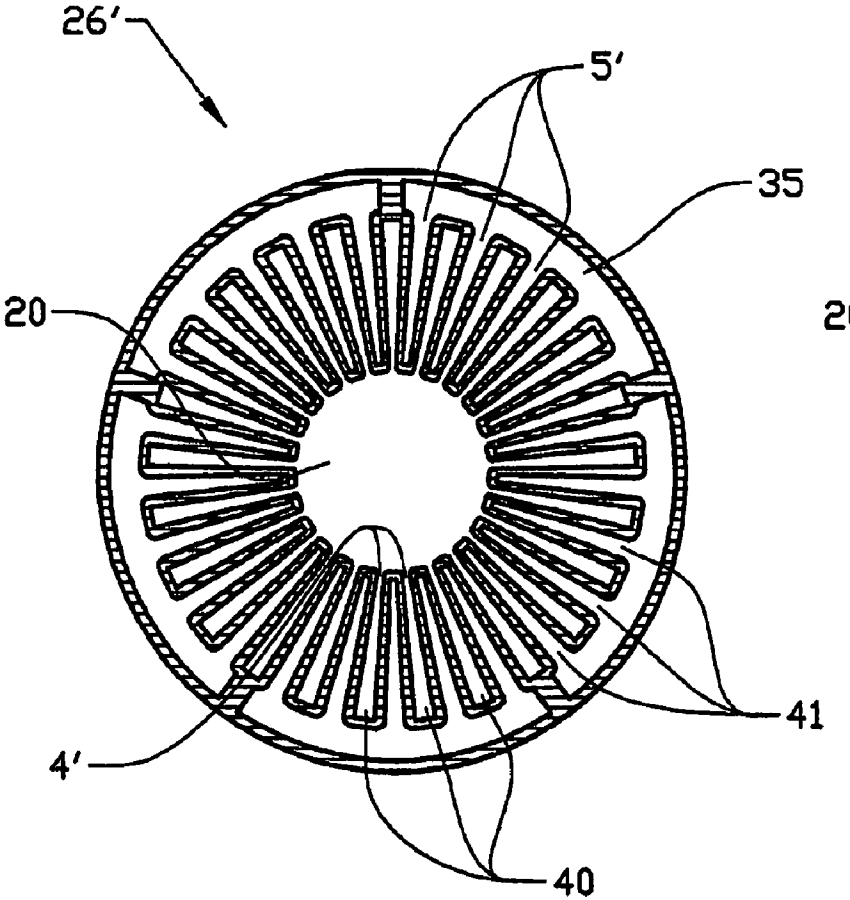
FIG. 8 is a cross-sectional view taken at the position of line A-A in FIG. 3, but demonstrating an alternative variant of the second advantageous embodiment of the invention.

FIGS. 8 and 9 show an alternative variant of the second embodiment of the invention. The principal of this variant is similar, but the first and the second section has a different internal shape. FIG. 8 shows a sectional view A-A according to FIG. 3 of the alternative second section 26', and FIG. 9 shows a sectional view B-B according to FIG. 3 of the alternative first section 27'. Referring to FIG. 8, the second section 26' comprises a zigzag shaped wall structure forming a first set of channels 40 and a second set of channels 41, one set on each side of the zigzag shaped structure. The first set of channels 40 are, via the first openings 4', open to the internal cavity 20 and to the gas flow passages that are intended for an incoming gas flow: the inlet passages 11*a*. The second set of channels 41 are open to the gas flow passages that are intended for an outgoing gas flow: the outlet passages 11*b*, and to the outlet channels 35. The appearance of the gas flow passages 11*a*, 11*b* is shown in FIG. 9, wherein every second passage forms an inlet passage 11*a* and every second passage forms an outlet passage 11*b* in similarity to what is mentioned previously. In this variant of the invention, the gas flows in a similar way as described above; it enters the internal cavity 20 via the entrance opening 4, enters the first set of channels 40 via the first openings 4', flows through the inlet channels 11*a* to the reversing chamber 13 where it changes direction and flows through the outlet channels 11*b* to the second set of channels 41, and passes the second openings 5' into the outlet channels 35.

An advantage of using more than one sub-body, as exemplified in FIG. 3, is that the incoming gas flow can be divided into several smaller gas flows which increases the efficiency of the device and lowers the pressure drop over the construction. Of course, more than two sub-bodies can be arranged together. Other arrangements are also possible, one example is to arrange only one first section 27 adjacent to the second section 26, and thus to block the other side of the second section 26. This arrangement may be used to achieve a higher mechanical stability of the construction. Another alternative is to reverse the direction of the gas flow so that the gas enters the body 3 via the outlet channels 35 and exits the body 3 through the opening 4.

As seen from FIGS. 2 to 9, both the first section 27, 27' the second section 26, 26' exhibit a substantially unchanged cross section in the longitudinal direction of the body. This means that these sections may be produced by extruding means which is a cost-effective production method that is suitable both for metal and ceramic material. Preferably, all sections/parts of the construction are made out of a ceramic material and joined to each other by sintering means. This gives a durable construction. To achieve a heat exchange effect between the inlet and outlet passages, the walls separating the passages must be reasonably thin. For a ceramic material a wall thickness of about 0.1 mm would give a fast heat transfer through the wall compared to the heat transfer from the gas to the wall. An example of a suitable ceramic material is cordierite.

Figure 10:
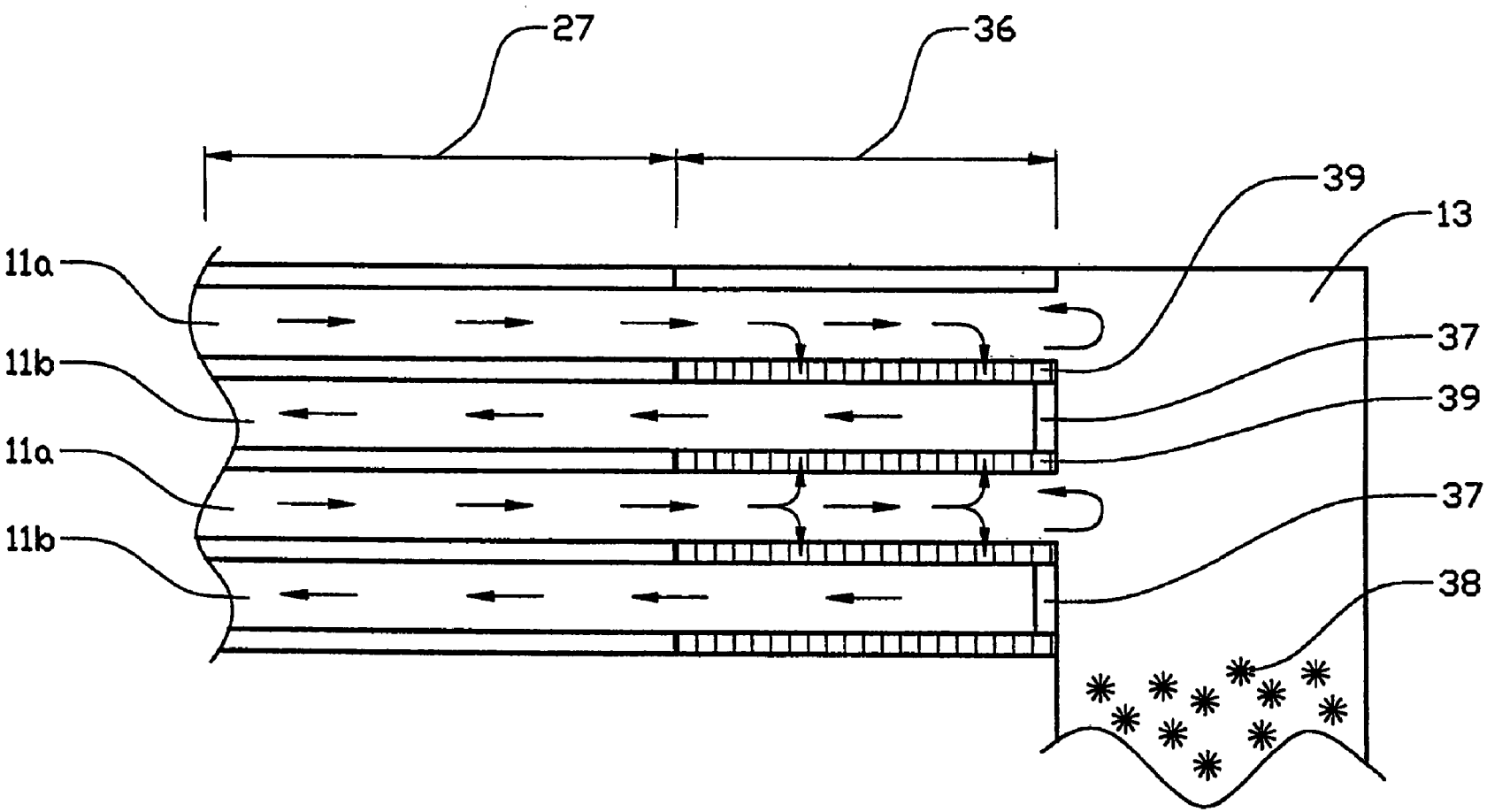
FIG. 10 is a schematic diagram showing a further development of the second embodiment of the invention according to FIGS. 2 and 3.

A further development of the second embodiment of the invention (FIGS. 2 and 3) is the adaptation of the device to remove particulates in the gas. FIG. 10 shows schematically the principles of a third section 36 arranged between a first section 27 and the section forming the reversing chamber 13. Although the design of the reversing chamber 13 may be similar to the above descriptions, it has in this case a different function as will be described below. Both the first section 27 and the third section 36 are provided with gas flow inlet and outlet passages 11*a*, 11*b* as described above. Plugs 37 close the outlet passages 11*b* to the reversing chamber 13.

The walls 39 between the passages 11*a*, 11*b* in the third section 36 are permeable to the gas flow and exhibit preferably a porous structure through which gas can pass but not particles (larger than a certain size), which particles at least partly will be deposited in the reversing chamber 13. These gas flow permeable walls 39 thus work as filters. Due to the plugs 37, a pressure builds up in the reversing chamber 13. The gas flow in the inlet passages 11*a* is thus forced through the walls 39 in the third section 36 into the outlet passages 11*b* back to the first section 27, as indicated by arrows in FIG. 10. Principally, the filtering process could be carried out in the first section 27, but permeable walls in this section would decrease the heat exchange properties. After some time, the filtering walls 39 and the reversing chamber 13 need to be regenerated by combustion of the soot.

Due to the heat exchange properties of the second embodiment of the invention, the heat evolved in this process can be utilized efficiently in that the outgoing gas preheats the incoming gas in the first section 27. As an aid in this process, a heating coil can be placed in the reversing chamber 13. In conventional ceramic particle filters, the ash produced in the soot combustion process accumulates in the filtering channels occupying useful filter volume. According to FIG. 10, the ash 38 can instead at least partly be accumulated in the reversing chamber 13. In some applications, the volume of the reversing chamber 13 is sufficient for accumulating ash 38 during the service life of the gas treatment device. In other cases it is possible to provide the reversing chamber 13 with emptying means, such as an opening that is closed under normal operation.

The third section 36 shown in FIG. 10 is easily adapted to fit between the first section 27 and the section forming the reversing chamber 13 shown in FIGS. 2 and 3. Further, the principal shape of the third section 36 is the same as that of the first section 27; the internal structures differ essentially in that the walls 39 in the third section are permeable to the gas flow. Thus, also the third section 36 exhibits a substantially unchanged cross section in a certain direction and may therefore be produced by extruding means, be made out of a ceramic material, and joined by sintering to other ceramic sections. The plugs 37 can be arranged by conventional means during or after the extrudation process. Of course, the third section 36 can be adapted to be used together with the alternative first section 27' shown in FIG. 9.

Although the use of the ash-accumulating reversing chamber 13 is advantageous, it is also possible to use the third section 36 without the reversing chamber 13 e.g. by plugging also the inlet passages 11*a* or by substituting the reversing chamber 13 for a delimiting plate 24.

An advantage of using a counter-current heat exchange in the treatment of a gas flow according to the second embodiment of the invention is that the heat can be utilized very efficiently. Besides the amount of heat contained in the incoming gas, heat may be supplied to the gas from exothermic reactions in the body, preferably by using a catalyst material that has been coated onto at least a part of the surfaces in the body that are in contact with the gas flow. Heat may also be supplied by an external source such as a heat generator preferably arranged in the reversing zone. As the outgoing gas flow during its transport from the reversing chamber 13 to the second opening 5' can transfer a great deal of its heat to the incoming gas flow from the first opening 4' to the reversing chamber 13, only a small part of the supplied heat will leave the body 3 with the outgoing gas flow and thus be wasted. A good heat economy is especially important if the incoming gas flow is relatively cold so that the temperature might fall below the catalyst light-off temperature described previously. An example of this is when the device is applied to purify the exhaust gases of a diesel engine.

The heat exchange process according to the second embodiment of the invention is also very useful in temperature transient situations, such as the purification of exhaust gases during a cold start situation. In such an application of the invention, the body 3 is preferably provided with both a catalyst material and an adsorption/desorption agent applied to at least a part of the surfaces in the body 3 that are in contact with the gas flow. The agent preferably adsorbs hydrocarbons and/or nitrogen oxides at, or below, a first temperature and releases them at, or above, a second temperature which is higher than the first temperature.

As the exhaust gases enter the cold body 3, heat will be transferred from the gas to the material comprised in the body 3. The first part of the heat exchanger surfaces, i.e. the material in or close to the second section 26 located closest to the first opening 4', heats up quickly while the part close to the reversing chamber 13 heats up slowly. As the body is arranged to permit heat exchange between adjacent passages, also the heat exchanger surfaces closest to the second opening 5' will heat up quickly. A gas flow passing the device shortly after start up will thus experience a first hot zone at the entrance of the body 3, a zone with gradually decreasing temperature (the inlet passages 11*a*), a zone with gradually increasing temperature (the outlet passages 11*b*), and a second hot zone before exit out of the body 3.

Compounds adsorbed onto adsorption/desorption agents applied to surfaces in the first hot zone will relatively quickly desorb, but will be adsorbed again onto agents applied to colder surfaces close to the reversing chamber 13. As the temperature with time also increases close to the reversing chamber 13, the compounds will again desorb. This time, however, the compounds will be transported towards zones with higher temperatures. By properly designing the body and choosing catalyst material and adsorption/desorption agents, the temperature in at least the hottest zone will be above the catalyst light-off temperature so that the compounds are converted efficiently.

In order to improve the heat economy and to reduce the amounts of adsorption/desorption agents and catalysts required, one may carefully choose the body surfaces to which catalysts and agents should be applied. For instance, catalysts for oxidizing HC and CO and reducing NOx may chiefly be applied in the hotter zones of the body (in or close to the second section 26), and adsorption/desorption agents may chiefly be applied in the colder zones (in or close to the reversing chamber 13).

In order to control the temperature of the gas flow in the body, the device preferably comprises one or several of the following: a heat generator arranged in the body (preferably arranged in the reversing chamber), cooling flanges arranged in the body, arrangements for introducing cooling air into the body, and/or a system for controlling the composition of the incoming gas flow. The system preferably comprises an arrangement for introduction of oxidizing species, such as air, into the incoming gas flow, and/or an arrangement for introduction of oxidizable species, such as hydrocarbons, into the incoming gas flow. Due to the heat exchange properties of the device, the heat generated in the induced chemical reactions can effectively be taken care of.

If the device is arranged in connection to an engine, the system for controlling the composition of the incoming gas flow preferably comprises an arrangement for controlling the operation of the engine, which operation in turn can affect the composition of the incoming gas flow. For instance, by mixing additional amounts of fuel in one or several of the cylinders one may introduce fuel, i.e. hydrocarbons, into the exhaust gas that is to be purified in the gas treatment device.

The second embodiment of the invention is not limited to the above description. For instance, the reversing zone may be designed in different ways. One example is to substitute the reversing chamber 13 for transfer passages, e.g. holes, between the gas flow inlet and outlet passages. In the case of the further development of the second embodiment of the invention shown in FIG. 10, the reversing zone is arranged by using permeable walls 39. Further, it is possible to use a conventional monolith with a large number of narrow flow passages (and provided with the internal cavity 20) as an alternative to the first sections 27, 27' shown in FIGS. 5 and 9. Each of the gas flow passages in FIG. 5 or 9 would in such a case be substituted for a number of more narrow passages side by side. With a proper design, this arrangement would give a more stable construction and only have a slight effect on the heat exchange (due to the additional body content of material required for the additional walls). However, it would increase the pressure drop and require more material.

It should be appreciated that the invention is not limited to the above described embodiments, but a number of modifications are possible within the frame of the claims.

For instance, the body 3 may be composed of many more first 27 and second sections 26, and the body may also comprise other types of sections with other structures.

It is not necessary that the sections are joined together directly, they might also be joined indirectly via a part situated in between the sections.

Modifications within the frame of the claims are also possible to improve the gas flow through the body in order to reduce the pressure drop, distribute the gas flow in a better way or make the heat exchange more efficient. Such modifications may depend on the application of the invention. In the case of the second embodiment shown in FIGS. 2-7, and its alternative variant shown in FIGS. 8-9, one may for instance vary the number of sub-bodies or connect a second section 26 to only one first section 27. Further, one may vary the design of the walls forming the gas flow passages 11 in order to vary the size of the surface area and/or the number of gas flow passages 11, or arrange so that the flow resistance of the passages 11 varies with the distance from the internal cavity 20. Additionally, one may vary the diameter of the internal cavity 20 which will affect the distribution of the gas flow. A larger diameter would for instance reduce the gas velocity which in turn would decrease the pressure drop caused by the deflection of the gas flow from the internal cavity 20 into the second section 26.

Of course it is also possible to provide the first section 27 with gas permeable walls 39 so that the first section 27 exhibits both heat exchange and filtering properties. In such a case it is not necessary to use an additional third section 36 to achieve filtering properties.

The invention claimed is:

1. A device for treatment of a gas flow, said device comprising:

at least one body (3) configured to cause a conversion in the composition of a gas flow during operation of the device, said body (3) having a modular construction comprising a plurality of sections (26, 26', 27, 27', 36), each with different internal structures that allow gas to flow therethrough, said sections (26, 26', 27,27', 36) being arranged so that at least a portion of the gas flows through at least two sections, each of said sections having different internal structures that form gas flow passages (11*a*, 11*b*) and at least one of said sections (26, 26', 27, 27', 36) comprising an internal cavity (20) extending substantially parallel to the gas flow passages (11*a*, 11*b*) of that section and which are distributed around said internal cavity (20), wherein the body (3) comprises at least one first section (27) that is provided with a plurality of gas flow passages (11) that extend essentially parallel to each other and wherein the body (3) is arranged to permit heat exchange between gas flows in adjacent gas flow passages (11) and said device being arranged so that the main direction of the gas flow in one gas flow passage (11) is essentially the opposite of the main direction of the gas flow in an adjacent gas flow passage (11) during operation of the device.

2. The device as recited in claim 1, wherein at least one of said sections (26, 26', 27, 27', 36) exhibits a substantially unchanged cross section along a longitudinal axis thereof.

3. A device as recited in claim 1, wherein said sections (26, 26', 27, 27', 36) substantially are made out of a ceramic material.

4. A device as recited in claim 1, wherein said plurality of gas flow passages (11) per cross section area unit differs between the first section (27) and the second section (26).

5. A device as recited in claim 4, wherein the first and the second sections (26, 27) are arranged so that at least a portion of the walls that define the gas flow passages (11) in the first section (27) form extensions of at least a portion of the walls that define the gas flow passages (11) in the second section (26).

6. A device as recited in claim 1, wherein gas flow passages (11) form inlet passages (11*a*) that are intended for an incoming gas flow and outlet passages (11*b*) that are intended for an outgoing gas flow, and that a reversing zone (13) is arranged in connection with said first section (27) so that gas entering said reversing zone (13) from the inlet passages (11*a*) is permitted to change direction and flow back through the outlet passages (11*b*).

7. A device as recited in claim 6, wherein the reversing zone (13) comprises a reversing chamber (13).

8. A device as recited in claim 6, wherein the body (3) comprises at least one second section (26, 26') that is provided with at least one first opening (4') for the entrance of an incoming gas flow, and that said second section (26, 26') is arranged in connection to at least one first section (27, 27'), and that said second section (26, 26') is adapted to distribute the incoming gas flow to the said inlet passages (11*a*).

9. A device as recited in claim 8, wherein said second section (26, 26') is provided with at least one second opening (5') for the exit of an outgoing gas flow, and that said second section (26, 26') is adapted to lead the outgoing gas flow out from said outlet passages (11*b*).

10. A device for treatment of a gas flow, said device comprising:

at least one body (3) configured to cause a conversion in the composition of a gas flow, said body (3) having a modular construction comprising a plurality of sections (26, 26', 27, 27', 36), each with different internal structures that allow gas to flow therethrough, said sections (26, 26', 27,27', 36) being arranged so that at least a portion of the gas flows through at least two sections with different internal structures during operation of the device;

said body (3) comprises at least one first section (27) that is provided with a plurality of gas flow passages (11) that extend essentially parallel to each other and said body (3) is arranged to permit heat exchange between gas flows in adjacent gas flow passages (11);

gas flow passages (11) form inlet passages (11*a*) that are intended for an incoming gas flow and outlet passages (11*b*) that are intended for an outgoing gas flow, and that a reversing zone (13) is arranged in connection with said first section (27) so that gas entering said reversing zone (13) from the inlet passages (11*a*) is permitted to change direction and flow back through the outlet passages (11*b*); and said body (3) comprises at least one second section (26, 26') that is provided with at least one first opening (4') for the entrance of an incoming gas flow, and that said second section (26, 26') is arranged in connection to at least one first section (27, 27'), and that said second section (26, 26') is adapted to distribute the incoming gas flow to the said inlet passages (11*a*), wherein the second section (26) comprises a wall structure forming: at least one first channel (29) to which the incoming gas flow is fed; and a plurality of second channels (30) that extend from said first channel (29) and which second channels (30) are open to said inlet passages (11*a*).

11. A device as recited in claim 10, wherein said first channel (29) is closed to the gas flow passages (11*a*, 11*b*).

12. A device as recited in claim 10, wherein the wall structure forms a plurality of third channels (32) that are open to said outlet passages (11*b*) and said third channels (32) are formed between said second channels (30) using common walls.

13. A device for treatment of a gas flow, said device comprising:

at least one body (3) configured to cause a conversion in the composition of a gas flow, said body (3) having a modular construction comprising a plurality of sections (26, 26', 27, 27', 36), each with different internal structures that allow gas to flow therethrough, said sections (26, 26', 27,27', 36) being arranged so that at least a portion of the gas flows through at least two sections with different internal structures during operation of the device;

said body (3) comprises at least one first section (27) that is provided with a plurality of gas flow passages (11) that extend essentially parallel to each other and said body (3) is arranged to permit heat exchange between gas flows in adjacent gas flow passages (11);

gas flow passages (11) form inlet passages (11*a*) that are intended for an incoming gas flow and outlet passages (11*b*) that are intended for an outgoing gas flow, and that a reversing zone (13) is arranged in connection with said first section (27) so that gas entering said reversing zone (13) from the inlet passages (11*a*) is permitted to change direction and flow back through the outlet passages (11*b*);

said body (3) comprises at least one second section (26, 26') that is provided with at least one first opening (4') for the entrance of an incoming gas flow, and that said second section (26, 26') is arranged in connection to at least one first section (27, 27'), and that said second section (26, 26') is adapted to distribute the incoming gas flow to the said inlet passages (11*a*); and said second section (26, 26') is provided with at least one second opening (5') for the exit of an outgoing gas flow, and that said second section (26, 26') is adapted to lead the outgoing gas flow out from said outlet passages (11*b*), wherein the second section (26') comprises a zigzag shaped wall structure forming a first and a second set of channels (40,41), one set on each side of said zigzag shaped structure, wherein said first set of channels (40) are open to said inlet passages (18*a*) and said second set of channels (41) are open to said outlet passages (11*b*), and wherein the incoming gas flow is fed to the first set of channels (40).

14. A device for treatment of a gas flow, said device comprising:

at least one body (3) configured to cause a conversion in the composition of a gas flow, said body (3) having a modular construction comprising a plurality of sections (26, 26', 27, 27', 36), each with different internal structures that allow gas to flow therethrough, said sections (26, 26', 27,27', 36) being arranged so that at least a portion of the gas flows through at least two sections with different internal structures during operation of the device;

said body (3) comprises at least one first section (27) that is provided with a plurality of gas flow passages (11) that extend essentially parallel to each other and said body (3) is arranged to permit heat exchange between gas flows in adjacent gas flow passages (11); and gas flow passages (11) form inlet passages (11*a*) that are intended for an incoming gas flow and outlet passages (11*b*) that are intended for an outgoing gas flow, and that a reversing zone (13) is arranged in connection with said first section (27) so that gas entering said reversing zone (13) from the inlet passages (11*a*) is permitted to change direction and flow back through the outlet passages (11*b*), wherein said first section (27, 27') comprises an internal cavity (20) that extends substantially parallel to said gas flow passages (11*a*, 11*b*), and that said gas flow passages (11*a*, 11*b*) are distributed around said internal cavity (20).

15. A device for treatment of a gas flow, said device comprising:

at least one body (3) configured to cause a conversion in the composition of a gas flow, said body (3) having a modular construction comprising a plurality of sections (26, 26', 27, 27', 36), each with different internal structures that allow gas to flow therethrough, said sections (26, 26', 27,27', 36) being arranged so that at least a portion of the gas flows through at least two sections with different internal structures during operation of the device;

said body (3) comprises at least one first section (27) that is provided with a plurality of gas flow passages (11) that extend essentially parallel to each other and said body (3) is arranged to permit heat exchange between gas flows in adjacent gas flow passages (11);

gas flow passages (11) form inlet passages (11*a*) that are intended for an incoming gas flow and outlet passages (11*b*) that are intended for an outgoing gas flow, and that a reversing zone (13) is arranged in connection with said first section (27) so that gas entering said reversing zone (13) from the inlet passages (11*a*) is permitted to change direction and flow back through the outlet passages (11*b*); and said body (3) comprises at least one second section (26, 26') that is provided with at least one first opening (4') for the entrance of an incoming gas flow, and that said second section (26, 26'is arranged in connection to at least one first section (27, 27'), and that said second section (26, 26') is adapted to distribute the incoming gas flow to the said inlet passages (11*a*), wherein said second section (26, 26') comprises an internal cavity (20), and that at least one first or second opening (4', 5') is directed towards said cavity (20) so that gas flow via said cavity (20) during operation of the device.

16. A device for treatment of a gas flow, said device comprising:

at least one body (3) configured to cause a conversion in the composition of a gas flow, said body (3) having a modular construction comprising a plurality of sections (26, 26', 27, 27', 36), each with different internal structures that allow gas to flow therethrough, said sections (26, 26', 27,27', 36) being arranged so that at least a portion of the gas flows through at least two sections with different internal structures during operation of the device; and said body (3) comprises at least one first section (27) that is provided with a plurality of gas flow passages (11) that extend essentially parallel to each other and said body (3) is arranged to permit heat exchange between gas flows in adjacent gas flow passages (11), wherein the body (3) has a substantially cylindrical shape, and said body (3) comprising an internal cavity (20) that extends in the longitudinal direction of the body (20), and that the device is arranged in such a way that at least one of (i) incoming gas enters the body (3) via said internal cavity (20) and (ii) outgoing gas exits the body (3) via said internal cavity (20) during operation of the device.

17. A device for treatment of a gas flow, said device comprising:

at least one body (3) configured to cause a conversion in the composition of a gas flow, said body (3) having a modular construction comprising a plurality of sections (26, 26', 27, 27', 36), each with different internal structures that allow gas to flow therethrough, said sections (26, 26', 27,27', 36) being arranged so that at least a portion of the gas flows through at least two sections with different internal structures during operation of the device;

said body (3) comprises at least one first section (27) that is provided with a plurality of gas flow passages (11) that extend essentially parallel to each other and said body (3) is arranged to permit heat exchange between gas flows in adjacent gas flow passages (11); and gas flow passages (11) form inlet passages (11*a*) that are intended for an incoming gas flow and outlet passages (11*b*) that are intended for an outgoing gas flow, and that a reversing zone (13) is arranged in connection with said first section (27) so that gas entering said reversing zone (13) from the inlet passages (11*a*) is permitted to change direction and flow back through the outlet passages (11*b*), wherein the body (3) comprises at least one third section (36) provided with walls (39) that are permeable to the gas flow, said third section (36) being primarily adapted to remove particulates from the gas.

18. A device as recited in claim 17, wherein the third section (36) is arranged between the first section (27, 27') and the reversing chamber (13), and that said permeable walls (39) essentially defines an extension of the gas flow passages (11*a*, 11*b*) in the first section, and that the outlet passages (11*b*) are closed to the reversing chamber (13) so that the gas is forced to flow through said permeable walls (39) during operation of the device.

19. A device as recited in claim 1, wherein at least a part of the surfaces in the body (3) that are in contact with the gas flow are coated with a catalyst material.

20. A device as recited in claim 1, wherein at least a part of the surfaces in the body (3) that are in contact with the gas flow are coated with an adsorption/desorption agent.

21. A device as recited in claim 1, further comprising means for controlling the temperature of the gas flow in the body (3), said means comprising at least one of: (i) a heat generator arranged in, or in connection to, the body (3); (ii) cooling flanges arranged in, or in connection to, the body (3); (iii) arrangements for introducing cooling air into the body (3); and (iv) a system for controlling the composition of the incoming gas flow.

22. A device as recited in claim 21, wherein said system for controlling the composition of the incoming gas flow comprises at least one of the following: (i) an arrangement for introduction of oxidizing species into the incoming gas flow; and (ii) an arrangement for introduction of oxidizable species into the incoming gas flow.

23. A device as recited in claim 21, wherein the device is arranged in connection to a combustion engine, and that said system for controlling the composition of the incoming gas flow comprises an arrangement for controlling the operation of the combustion engine, which operation in turn affects the composition of the incoming gas flow.

24. A device as recited in claim 1, wherein the device is adapted to purify the exhaust gas from an internal combustion engine.

25. A device as recited in claim 2, wherein a plurality of said sections (26, 26', 27, 27', 36) exhibit a substantially unchanged cross section in at least one certain direction.

26. A device as recited in claim 3, wherein said sections (26, 26', 27, 27', 36) are joined together by sintering.

27. A device as recited in claim 1, wherein said body (3) has a general shape of a circular cylinder.

28. A device as recited in claim 16, wherein the body (3) has a general shape of a circular cylinder.

29. A device as recited in claim 1, wherein the device is adapted to purify the exhaust gas from a mobile internal combustion engine.

30. A device for treatment of a gas flow, comprising a section (27) for counter-current heat exchange, the section having a plurality of gas flow passages which form inlet passages (11*a*) for incoming gas and a plurality of gas flow passages which form outlet passages (11*b*) for outgoing gas, the inlet passages (11*a*) terminating in a reversing zone (13) and the outlet passages (11*b*) extending from the reversing zone (13), the reversing zone being arranged for changing the direction of the gas flow from a first direction in the inlet passages to a second direction in the outlet passages, at least a part of the reversing zone (13) being arranged by using gas permeable walls (39) in a portion (36) of the section (27) which walls divide the gas flow passages into said inlet and outlet passages, and said outlet gas passages (11*b*) being closed to the reversing zone (13) so as to force the incoming gas through the gas permeable walls (39) into the outlet passages (11*b*) while depositing particles (38) in the reversing zone (13) during operation of the device.

31. A device for treatment of a gas flow, comprising at least one first section (27) for counter-current heat exchange, the first section (27) having a plurality of gas flow passages which form inlet passages (11*a*) for incoming gas and a plurality of gas flow passages which form outlet passages (11*b*) for outgoing gas, the inlet passages (11*a*) terminating in a reversing zone (13) and the outlet passages (11*b*) extending from the reversing zone (13), the reversing zone being arranged for changing the direction of the gas flow from a first direction in the inlet passages to a second direction in the outlet passages, and the device further comprising a second section (26) being provided with at least one first opening (4') for entrance of an incoming gas flow to the second section (26) and at least one second opening (5') for exit of the gas flow from the second section (26), said second section (26) having a plurality of distributing channels (30) arranged for distributing the incoming gas flow to the inlet passages (11*a*) of the first section (27), and a plurality of collecting channels (32) for collecting the outgoing gas flow from the outlet passages (11*b*) of the first section (27) and wherein the second section (26) has a ring-shaped cross section forming a cavity (20) inside the device which cavity allows the gas to flow in the longitudinal direction of the device, and said at least one first opening (4') for entrance of an incoming gas flow to the second section (26) being directed towards said cavity (20).

32. A device according to claim 31, wherein two said first sections (27) are arranged on opposite sides of the second section (26), the plurality of distributing channels (30) of the second section (26) being arranged for distributing the incoming gas flow to the inlet passages (11*a*) of both first sections (27), and the plurality of collecting channels (32) of the second section (26) being arranged for collecting the outgoing gas flow from the outlet passages (11*b*) of both first sections (27).

33. A device according to claim 31, wherein the device is provided with a housing enclosing the first section (27) and the second section (26) such that an outlet channel (35) is formed between the housing and the first and second sections in the periphery of the device, which outlet channel (35) allows the gas to flow in the longitudinal direction of the device, and said at least one second opening (5') for exit of the gas flow from the second section (26) being directed towards said outlet channel (35).

* * * * *

UNITED STATES PATENT AND TRADEMARK OFFICE

CERTIFICATE OF CORRECTION

PATENT NO. : 7,247,185 B2
APPLICATION NO. : 10/710969
DATED : July 24, 2007
INVENTOR(S) : Edward Jobson and Anna Holmgren Hagg It is certified that error appears in the above-identified patent and that said Letters Patent is hereby corrected as shown below:

On title page
Item (30) Foreign Application Priority Data insert

March 23, 2007 (SE) …….. 0200453-9

Signed and Sealed this

Fourth Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 7,247,185 B2 
APPLICATION NO. : 10/710969
DATED : July 24, 2007
INVENTOR(S) : Edward Jobson and Anna Holmgren Hagg It is certified that error appears in the above-identified patent and that said Letters Patent is hereby corrected as shown below:

On title page
Item (30) Foreign Application Priority Data insert

February 15, 2002 (SE) …….. 0200453-9

This certificate supersedes the Certificate of Correction issued December 4, 2007.

Signed and Sealed this

Seventh Day of October, 2008

JON W. DUDAS
*Director of the United States Patent and Trademark Office*